United States Patent [19]

Hopper

[11] Patent Number: 4,943,187

[45] Date of Patent: Jul. 24, 1990

[54] ROV INTERVENTION ON SUBSEA EQUIPMENT

[75] Inventor: Hans P. Hopper, Aberdeen, Scotland

[73] Assignee: British Petroleum Co. p.l.c., London, England

[21] Appl. No.: 272,192

[22] Filed: Nov. 16, 1988

[51] Int. Cl.[5] ..... F16L 29/00

[52] U.S. Cl. ..... 405/190; 405/188; 405/185; 166/338; 166/341

[58] Field of Search ..... 405/188, 189, 190, 191, 405/195, 169, 170; 166/338, 341; 251/149; 137/256.1

[56] References Cited

U.S. PATENT DOCUMENTS

| | | | |
|---|---|---|---|
| 3,347,567 | 10/1967 | Watkins | 166/341 X |
| 3,698,197 | 10/1972 | Bodey et al. | 405/188 |
| 3,891,181 | 6/1975 | Sanders . | |
| 3,976,347 | 8/1976 | Cooke et al. . | |
| 4,039,237 | 8/1977 | Cullen et al. . | |
| 4,662,389 | 5/1987 | Tgbal . | |
| 4,682,913 | 7/1987 | Shatto et al. . | |
| 4,708,524 | 11/1987 | Goris | 405/191 X |

FOREIGN PATENT DOCUMENTS

| | | | |
|---|---|---|---|
| 0162543 | 11/1985 | European Pat. Off. . | |
| 0235365 | 9/1987 | European Pat. Off. . | |
| 2093512 | 9/1982 | United Kingdom | 405/190 |
| 2069085 | 8/1983 | United Kingdom . | |
| 2171162 | 8/1986 | United Kingdom . | |
| 2180027 | 3/1987 | United Kingdom . | |

*Primary Examiner*—Dennis L. Taylor

*Attorney, Agent, or Firm*—David J. Untener; Larry W. Evans

[57] ABSTRACT

A projecting actuation point and a hollow ROV-operable tool for subsea equipment both have a larger diameter surface and a smaller diameter surface, the former being nearest to the subsea equipment. The smaller diameter surface of the actuation point provides a coarse guidance and early alignment of the tool over the actuation point and the larger and smaller surfaces, which fit closely, provide in combination two sets of interfaces for final alignment.

The principle can be applied to a wide variety of subsea parts. The actuation point can be a spigot for a valve or choke, a point for hydraulic or electrical connection, a point for both fluid injection and valve isolation or a coupling to link a subsea component with a subsea module or to a remote power source.

10 Claims, 13 Drawing Sheets

ROV INTERVENTION ON SUBSEA EQUIPMENT

Figure 1:
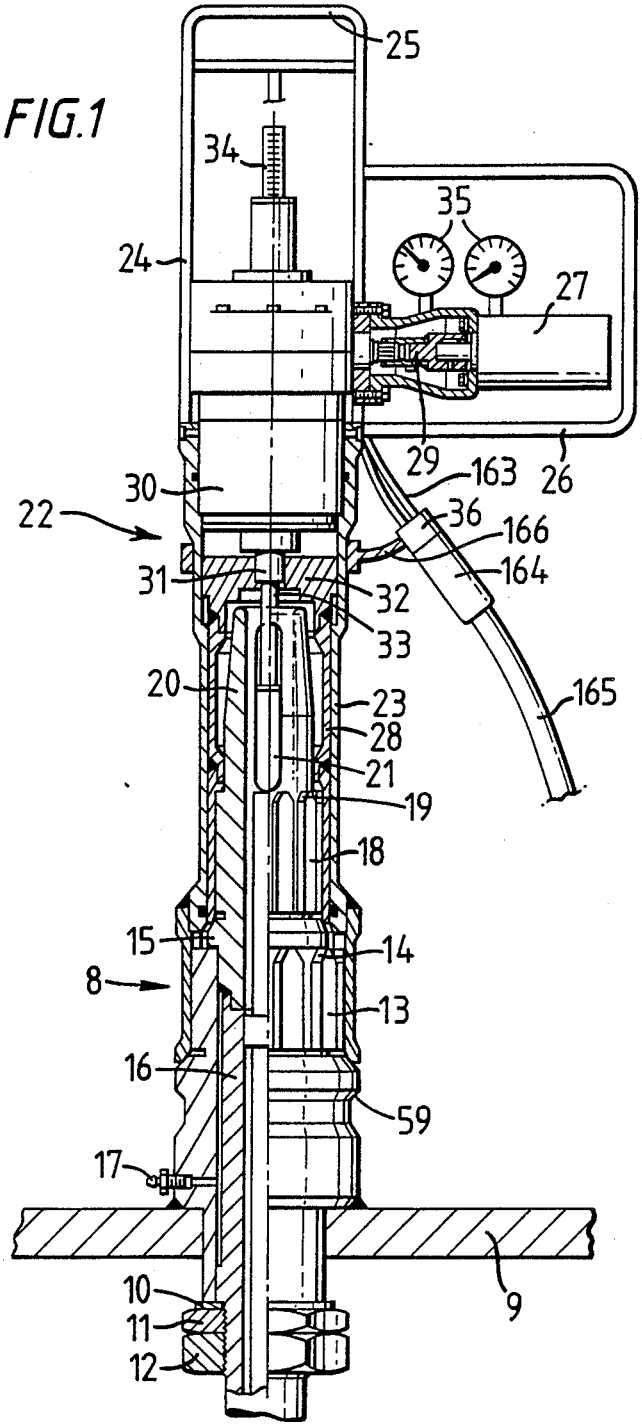

This invention relates to an actuation point for subsea equipment and to an ROV tool for actuating the point.

There are a considerable number of situations where ROV intervention on subsea equipment may be required. These include actuation of a spigot to open or close a valve, monitoring of hydraulic and/or electrical systems, injection of fluid (e.g. hydraulic, grease or di-electric fluid), supply of hydraulic and/or electrical power and interconnection between two modules.

The simplest form of ROV tool is a tool held on an ROV manipulator arm. A tool held in this way lacks dexterity and a sense of feel, being, in effect part of a rigid, powered handling system. Aligning and locating the tool on an actuation point can be an awkward operation.

Because of the limitations of simple manipulator tools, many present subsea oil production systems use more complex tools on an auxiliary frame. The frame is docked to a module and tools can be moved on the frame to align and enable with actuation points. This is a much more complex system requiring a special frame which may have to be specially designed to suit the subsea system. A specially adapted ROV may also be required to operate the frame.

The present invention is concerned with an actuation point and ROV tool for actuating the point which can be operated by a standard workclass ROV. It is designed to combine the simplicity of a manipulator tool with the precision of a frame tool.

According to the present invention an actuation point and ROV-operable tool for subsea equipment comprises means for locating the tool on the point formed of:

(a) an actuation point projecting from a subsea module having two tool guidance surfaces of different external diameters, the larger diameter surface being nearer to the module than the smaller diameter surface, and (b) a tool having a hollow interior adapted to fit over the actuation point and having two surfaces of different internal diameters, the larger diameter surface being at the end of the tool adjacent the module and adapted to fit closely over the larger guidance surface of the point, and the smaller diameter surface being adapted to fit closely over the smaller guidance surface of the point and means for actuating the point by the tool when so located, said means being selected from (c) a torque function in the tool cooperating with a rotatable spigot of the actuation point, (d) a stab function in the tool cooperating with a stab receptacle of the actuation point, (e) both torque and stab functions in the tool cooperating with an actuation point having both a rotatable spigot and stab receptacle.

The smaller guidance surface on the actuation point provides a coarse initial alignment of the tool over the point, further movement of the tool towards the module by its own weight or with assistance then aligning the tool precisely over the two guidance surfaces.

The larger guidance surface of the point is preferably fixed and immovable and provides the anchorage for the tool on the point. If desired, there may be a releasable lock for the surfaces. The smaller guidance surfaces of the point and of the tool while assisting with precise alignment may also provide the actuation mechanism. Thus for use with torque-function tools the smaller guidance surface of the point may be rotatable and attached to a valve stem, with the smaller surface of the tool being also rotatable, preferably by hydraulic or electrical power, to rotate the guidance surface and adjust the valve. Alternatively, with stab-function tools the actuation point and the tool may have one or more movable sleeves, the sleeve(s) of the tool being movable axially by hydraulic or electrical power to move the sleeve(s) of the actuation point.

The tool may have a releasable latch cooperating with a groove of the actuation point for releasably locking the tool to the point.

The tool and actuation point may also have ports which are uncovered by operating the torque or stab functions to allow fluid injection from the tool into the actuation point.

The tool may be located over the actuation point and operate it directly. Alternatively the tool may be formed of an upper part and a lower part, the upper part having a releasable lock for locking it to the lower part. The upper part is designed to deploy and locate the lower part on an actuation point so that by separating the upper and lower parts the lower part can, if required, be left over the actuation point. This use of a two-part tool gives the present invention greater versatility and flexibility, the lower part being able to provide at an actuation point any of the functions of a one part tool and also, by suitable design to provide a other capabilities such as a lifting capability.

Figure 2:
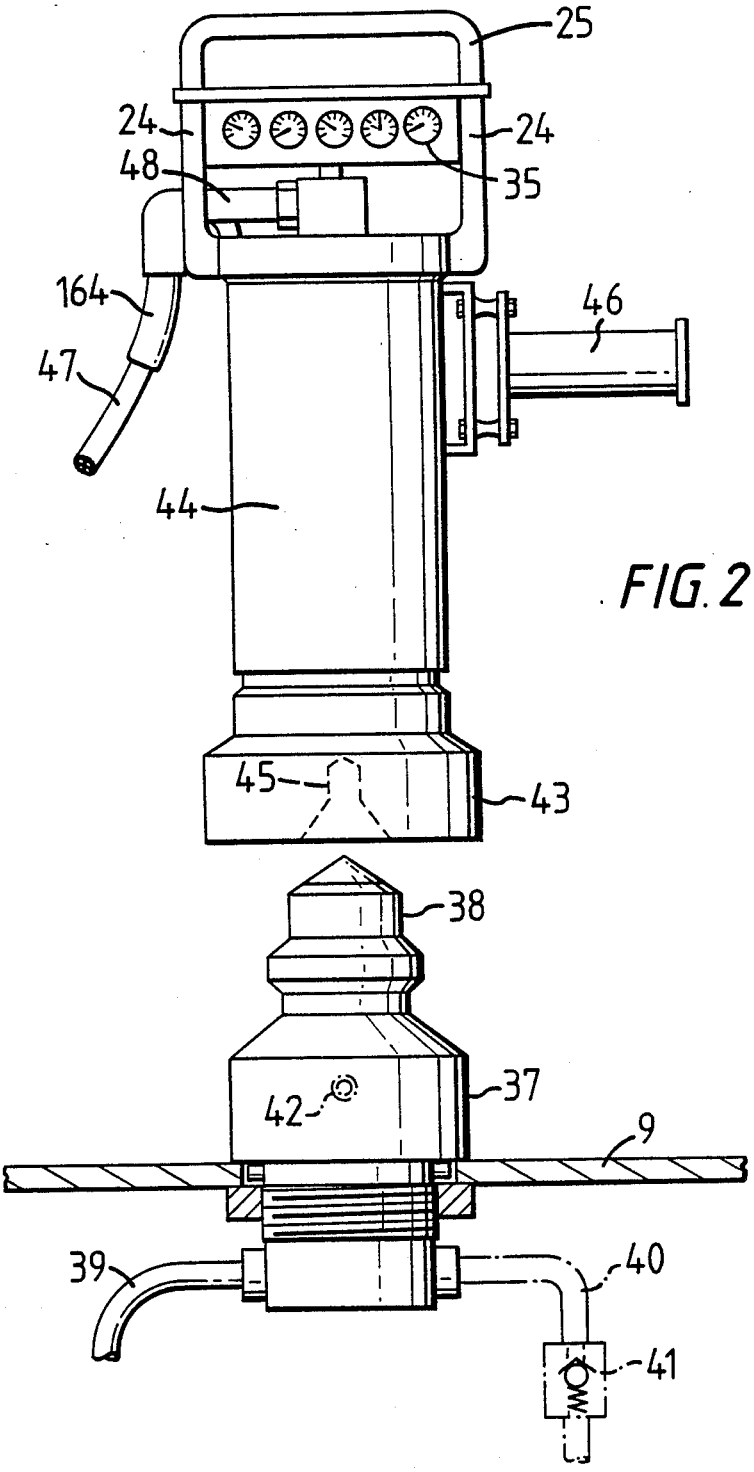
Figure 3:
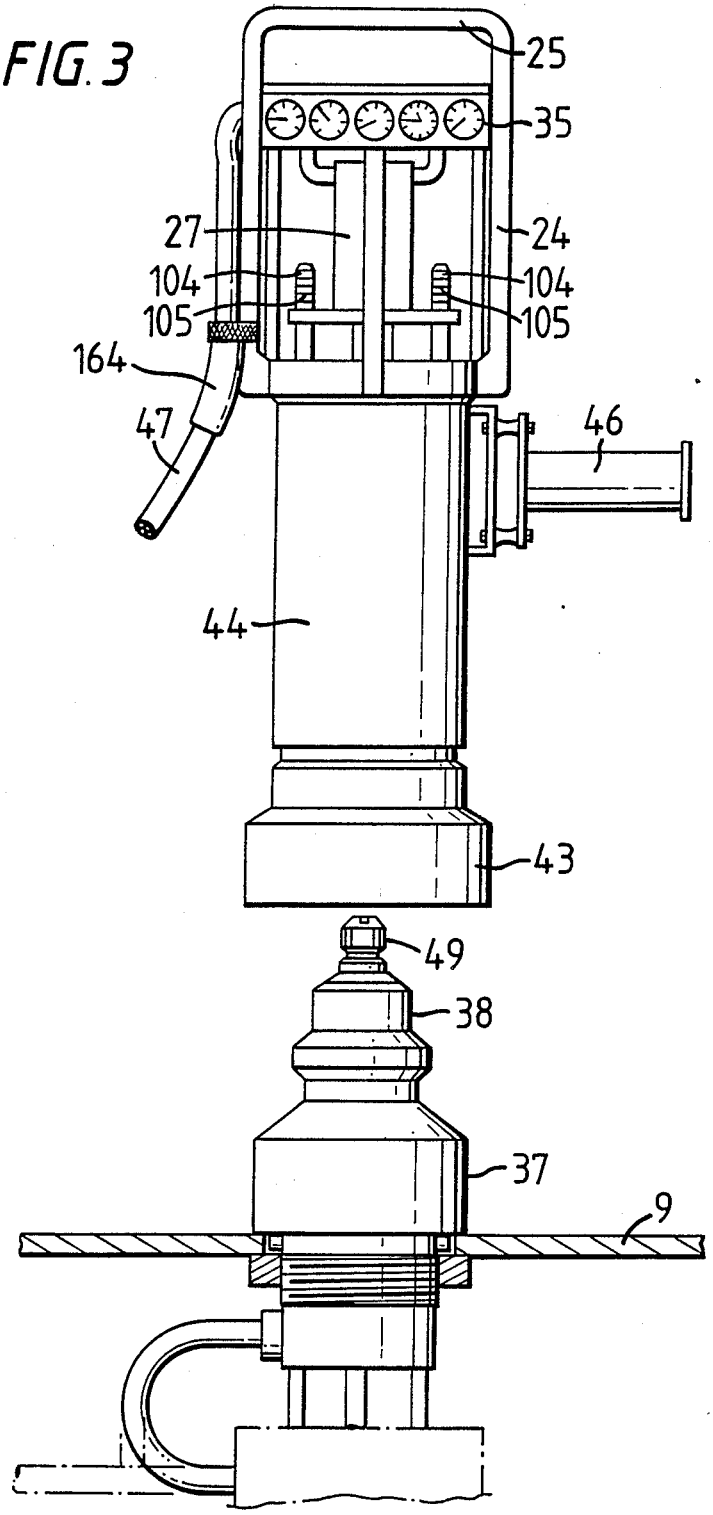
Figure 4:
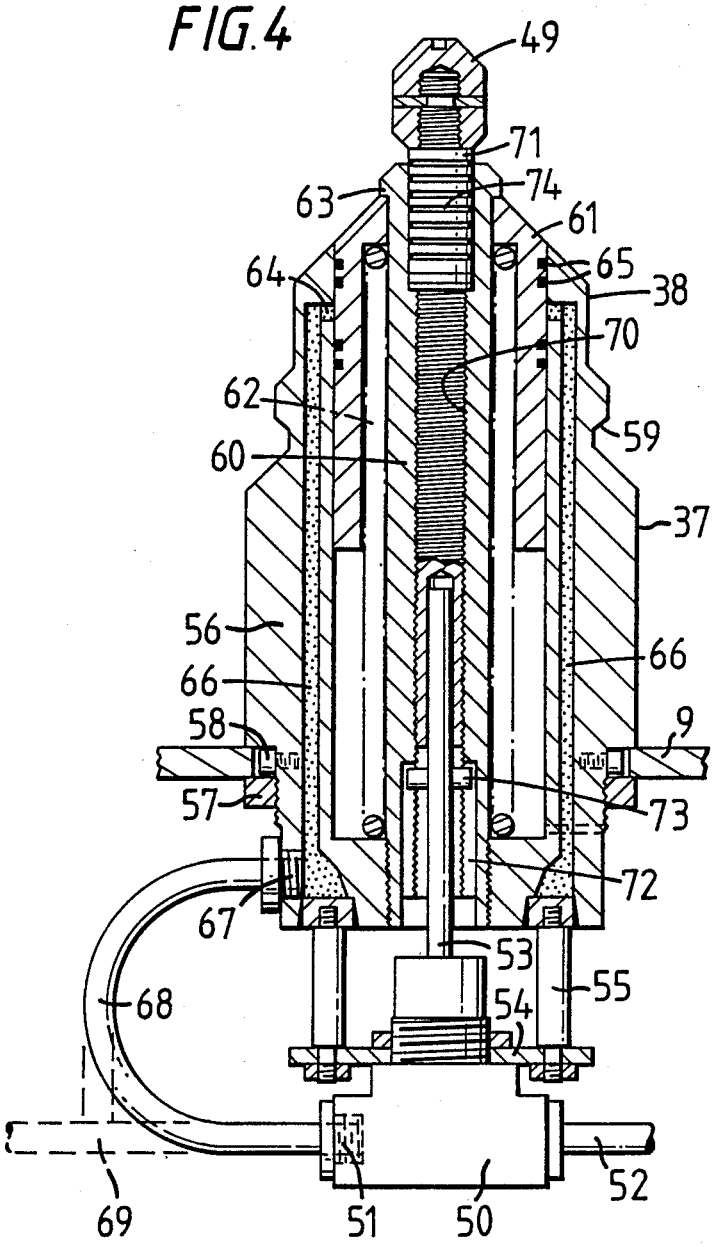
Figure 5:
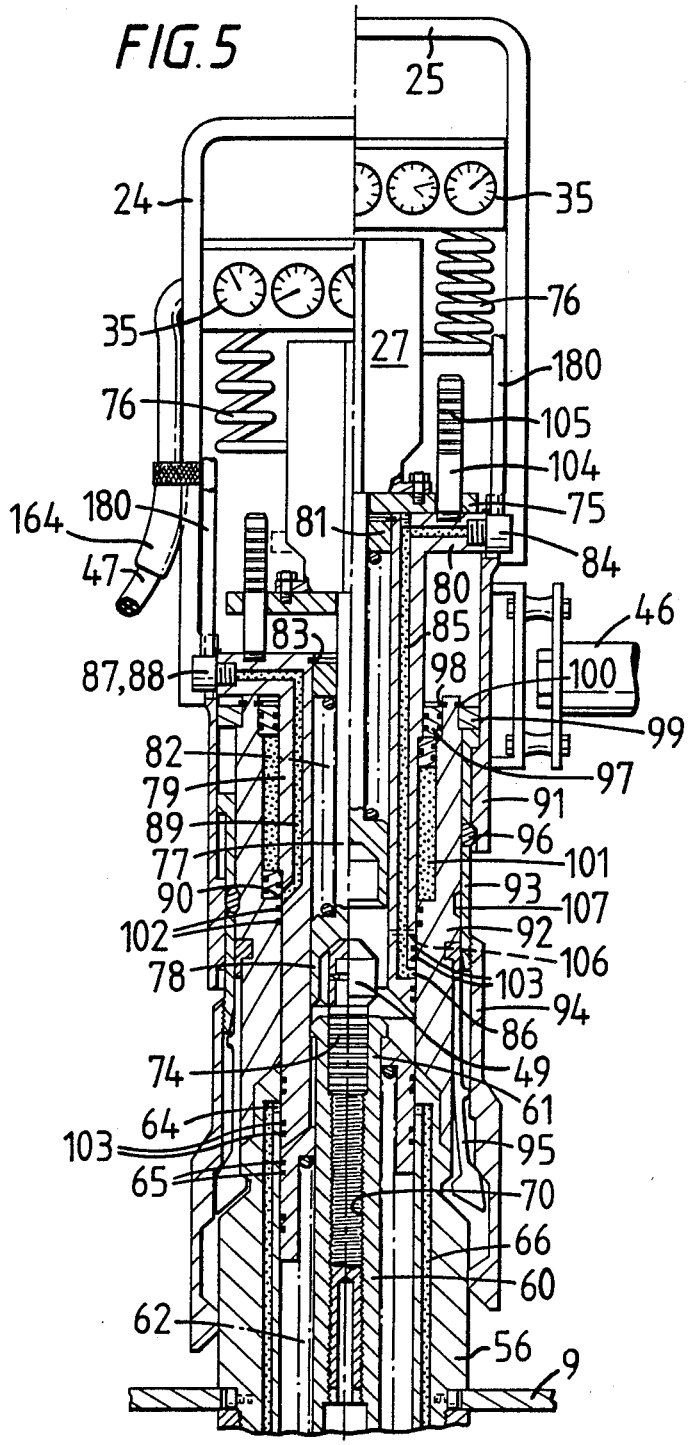
Figure 6:
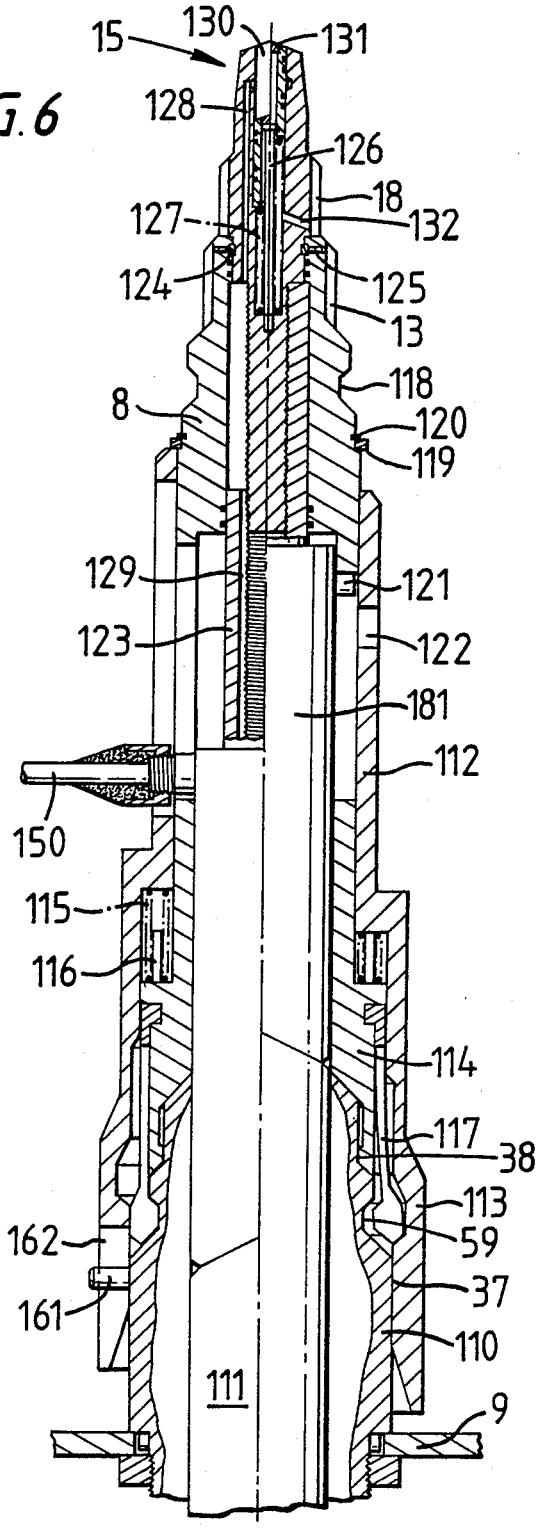
Figure 7:
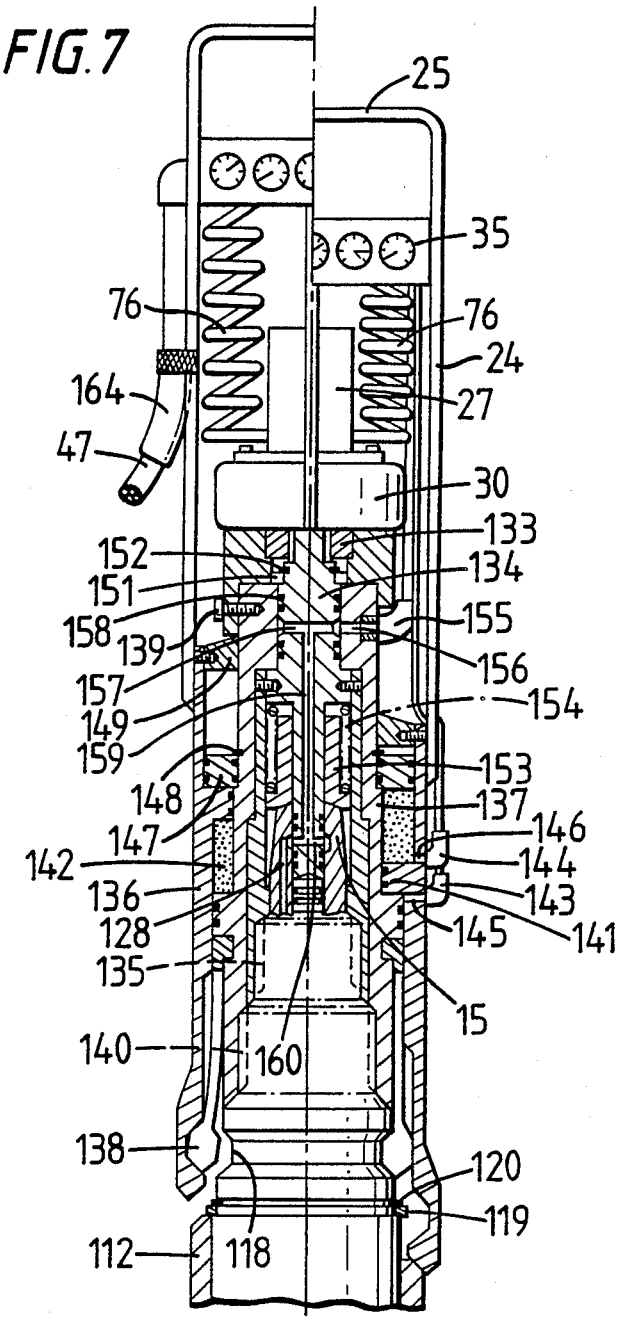
Figure 8A:
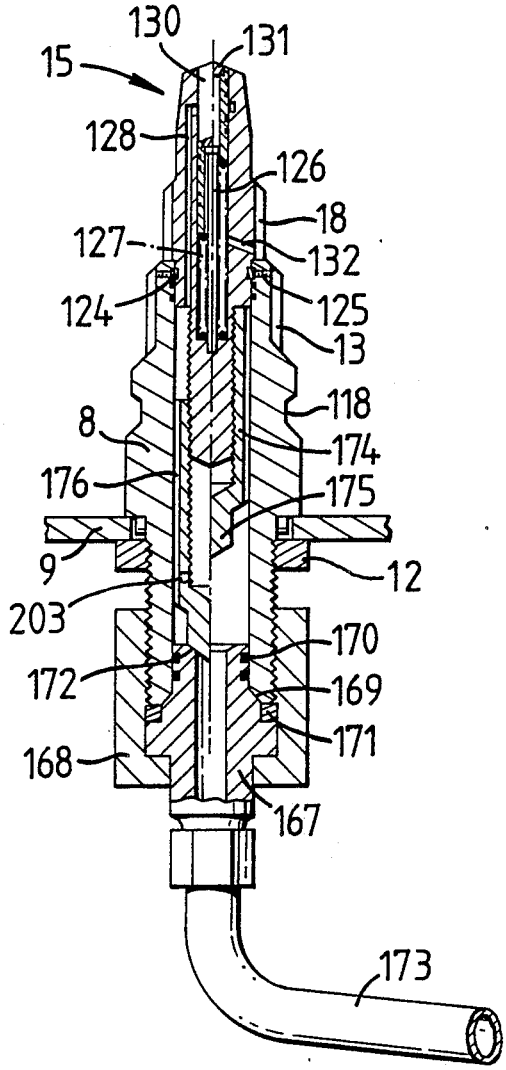
Figure 8B:
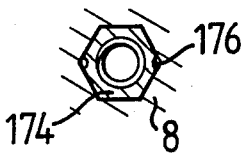
Figure 9:
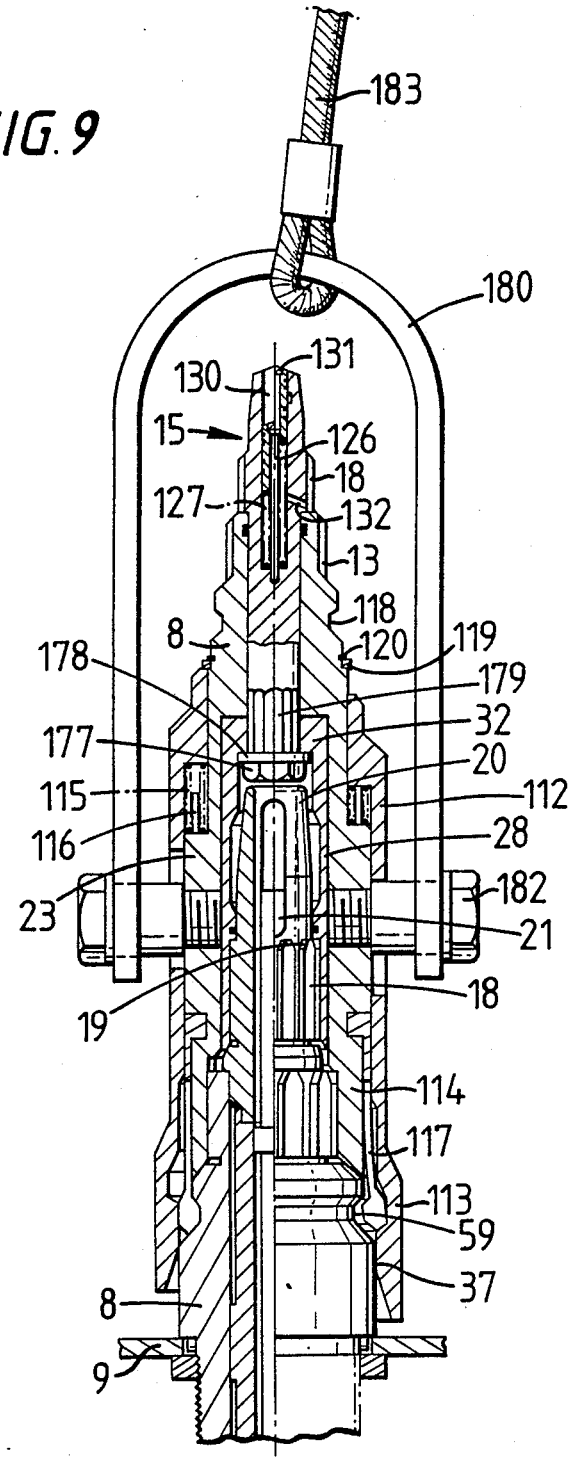
Figure 10:
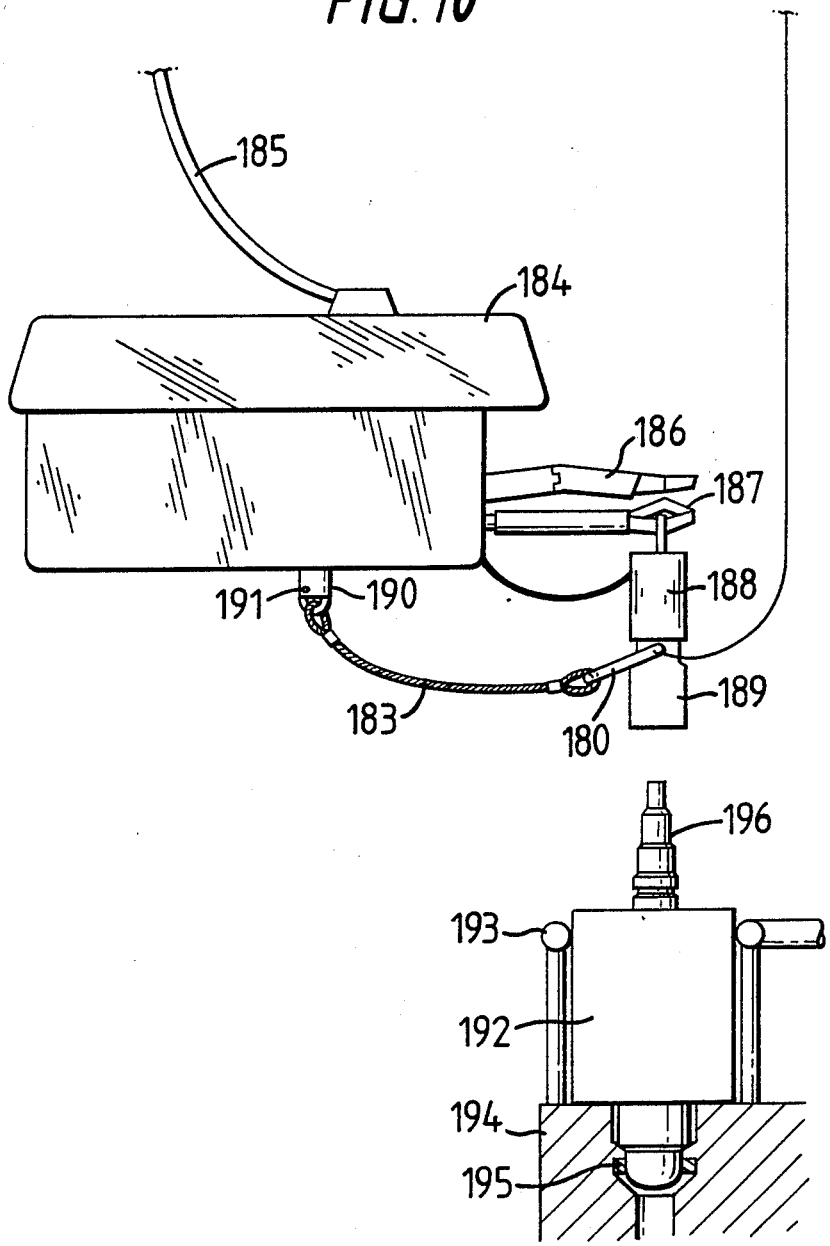
Figure 11:
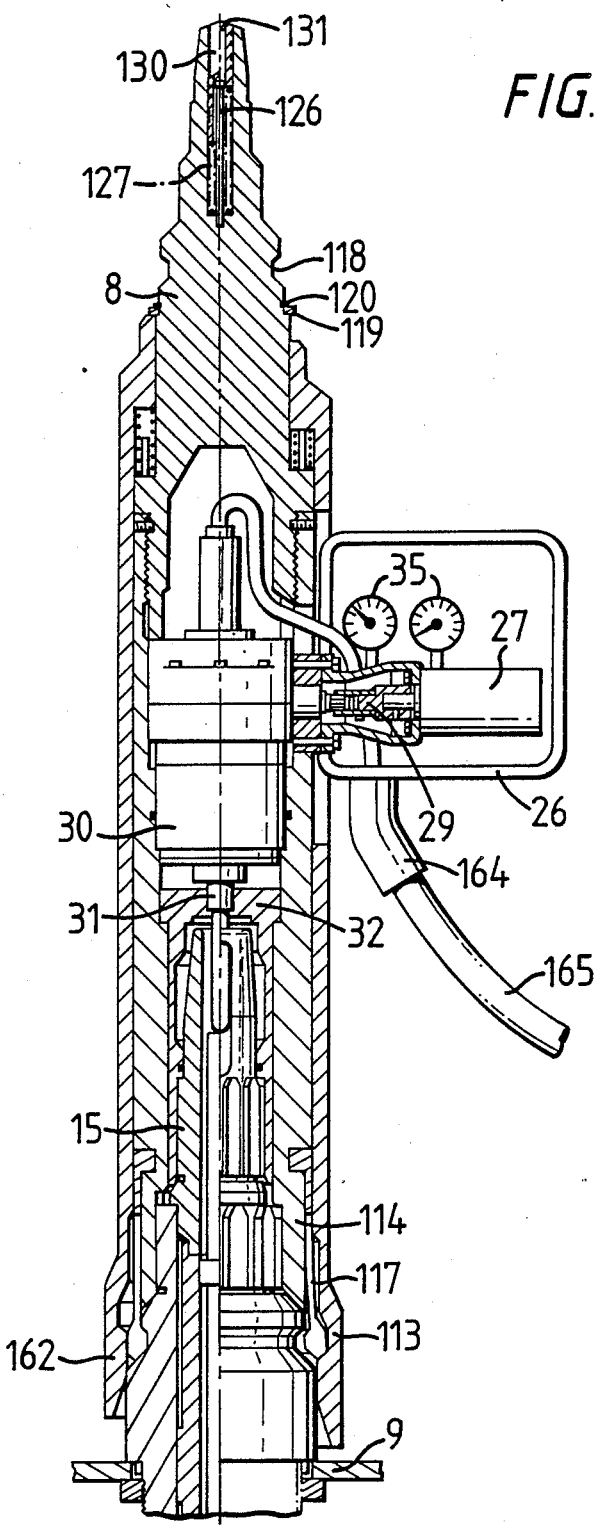
Figure 12:
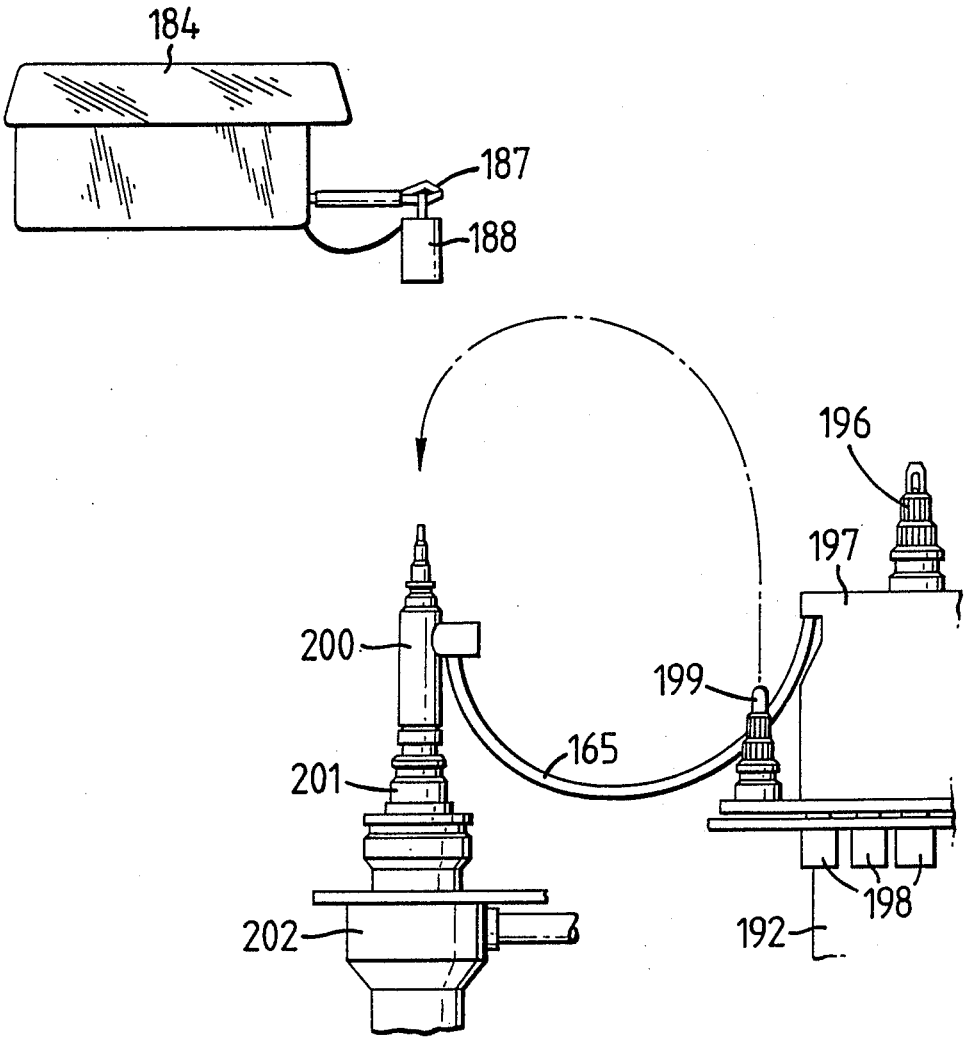
Figure 13:
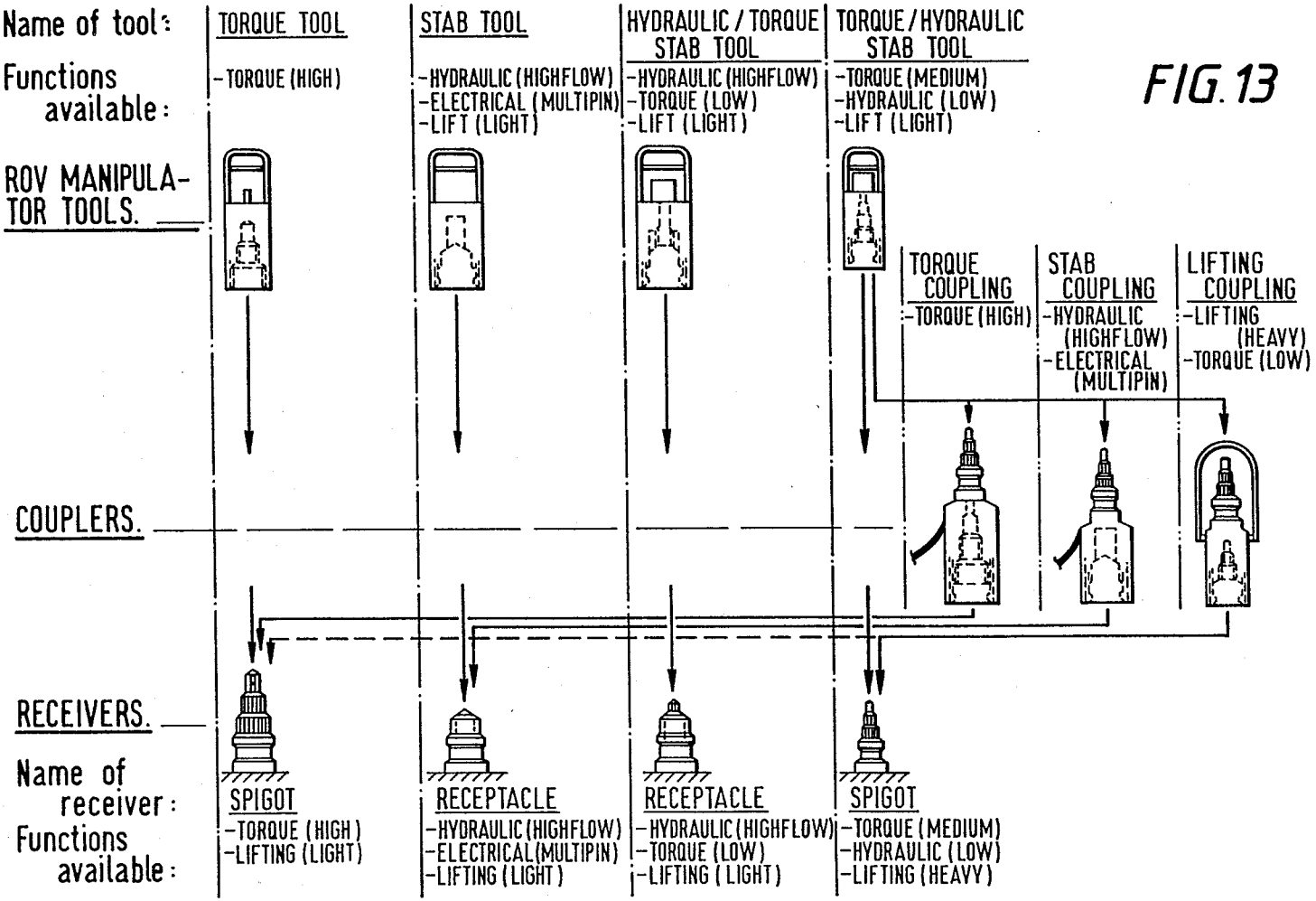

The invention is illustrated and further embodiments are described with reference to the accompanying drawings, in which FIG. 1 shows a spigot as an actuation point and a simple actuation tool over the spigot, FIG. 2 is a view of an actuation point and tool for electrical or hydraulic connection, FIG. 3 is a view of an actuation point and tool for hydraulic isolation and injection, FIG. 4 is a section through the actuation point of FIG. 3, FIG. 5 is a section through the tool and actuation point of FIG. 3, FIG. 6 is a section through an actuation point which is a hydraulic or electrical coupling, and FIG. 7 is a section through a universal tool suitable for use with the coupling of FIG. 6, the actuation point of FIG. 8A or the couplings of FIGS. 9, 10, 11 and 12, FIG. 8A is an actuation point which is a grease injection nipple, and FIG. 8B is a section through part of FIG. 8A, FIG. 9 is a lifting coupling, FIG. 10 is a drawing showing how the universal tool of FIG. 7 and the lifting coupling of FIG. 9 can be utilised, FIG. 11 is a torque control coupling, FIG. 12 is a drawing illustrating the use of the torque control coupling of FIG. 11, and FIG. 13 is a schematic drawing showing the relationship between the tools and couplings of FIGS. 1 to 12 and the ways in which they may be used.

In FIG. 1 a spigot indicated generally at 8 has a fixed outer portion welded to a structural plate 9 of a subsea oil production module. The spigot projects above the plate and has a lock groove 59 on its outer circumference for locking any required component to it. At the top of spigot 8 are reaction splines 13 on its outer circumference. The top of the splines are chamfered at 14.

Within the fixed outer portion of the spigot is a rotatable mandrel 15 which extends down through the spigot and plate as drive shaft 16 to a piece of equipment of the subsea module, e.g. a valve. Rotatable mandrel 15 is held within the fixed outer portion of the spigot by load washer 10, nut 11 and lock nut 12. There are suitable seals between the rotatable and non-rotatable portions of the spigots (i.e. adjacent the top and bottom of the fixed outer portion of the spigot) and the surfaces may be lubricated by grease supplied through a nipple 17. Rotatable mandrel 15 has external driving splines 18 which are also chamfered at 19. The rotatable mandrel terminates in a tapering portion 20 having within it an indicator rod 21.

A tool indicated generally at 22 fits over the spigot. It has an outer cylinder 23 which opens out at its base to be of a diameter such that it fits closely over reaction splines 13. The inside of the cylinder has corresponding splines to mate with the reaction splines. At the top of cylinder 23 is a framework 24 with a lifting handle 25 and a sideways extension 26 for a hydraulic motor 27.

Motor 27 drives a rotatable inner cylinder 28 within outer cylinder 23 through drive shaft 29, bevel gearing (not shown), a reduction gearbox 30, and stud 31 fitting within ring 32 at the top of inner cylinder 28. The bottom of cylinder 28 fits closely over driving splines 18, and has corresponding internal splines to mesh with driving splines 18. There is a degree of play between stud 31 and ring 32 equivalent to half the width of a spline so that the splines can mesh without the need to rotate the stud 31 and motor 27. A tool indicator rod 33 sits on mandrel indicator rod 21 and extends up through the drive gearing. Its top has graduation marks 34 that can be seen by a TV camera. There are gauges 35 to indicate hydraulic pressures, these also being visible to a TV camera. Hydraulic lines 36 supply hydraulic fluid to motor 27. These hydraulic lines 36 are part of an umbilical 165 from a suitable source of hydraulic fluid e.g. an ROV. To prevent kinking of the lines as they enter the tool, they may have a collar 163, a bend reducer 164, and a tension strap 166.

In the embodiment of FIG. 1 the spigot should be substantially vertical. In operation a manipulator arm of a standard ROV holds tool 22 by its lifting handle 25, brings it over the spigot, and lowers it so that the bottom of outer cylinder 23 goes over the top of rotatable mandrel 15. The rotatable mandrel acts as the smaller diameter surface of the actuation point and the inside of the bottom of outer cylinder 23 the larger diameter surface of the tool, providing a coarse alignment for the tool over the actuation point. There is considerable play so no great accuracy of placement or alignment is required from the manipulator arm.

Once coarsely aligned, the manipulator arm can be released or its grip relaxed. The tapered portion 20 of the mandrel, besides providing the initial coarse alignment, also prevents the tool from falling and cocking when the tool is released from the manipulator arm. Once freed or loosened from the ROV, the tool will move down onto the spigot under its own weight until the internal splines of outer cylinder 23 mesh with the reaction splines 13 of the spigot and the internal splines of inner cylinder 28 mesh with the driving splines of rotatable mandrel 15. The chamfered tops 14 and 19 of the sets of splines assist alignment as does the degree of play between stud 31 and ring 32.

The larger diameter surface (i.e. the reaction splines) of the actuation point has thus mated with the larger diameter surface (i.e. the splines at the bottom of outer cylinder 23) of the tool and the smaller diameter surface (i.e. the driving splines of mandrel 15) of the actuation point with the smaller diameter surface (i.e. the splines at the bottom of inner cylinder 28) of the tool. Being vertical the tool is firmly held by its own weight on the spigot without the need for a locking mechanism.

Hydraulic motor 27 is actuated to rotate mandrel 15 and operate whatever piece of equipment is at the end of drive shaft 16. Reverse rotation is actuated by the ROV supplying fluid in the opposite direction. The degree of torque applied is dependent on the pressure supplied by the ROV control pressure regulator. Once the equipment has been adjusted as necessary, as monitored by the marks 34 of tool indicator pin 33, the tool can be lifted off, the mandrel acting as a coarse alignment to lift the tool off substantially vertically until it is clear of the spigot.

The gauges 35 (visible to a TV camera) are provided to confirm to the surface operator that the instructions sent from a surface vessel through the ROV have been hydraulically transmitted to the tool. Lack of movement of the tool after being sent an instruction could mean that the system is already torqued up, or that there has been a malfunction and that no hydraulic fluid has reached the tool.

FIG. 2 is a view of an actuation point and tool suitable for making either an electric or hydraulic connection.

The actuation point is held in a subsea module by structural plate 9 and has a larger diameter surface 37 and smaller diameter surface 38. It connects with line 39 within the module which may be an electric line or a hydraulic line. Only one line is shown but there may be several lines if required. If the connection is electric there may also be a line 40 for dielectric fluid, this being a fluid vent line passing through a check valve 41. The point may have an orientation pin 42, this being possibly required to orientate the tool with the point in certain forms of connection.

The tool is similar in general design to that of FIG. 1 being hollow and having a larger diameter surface 43 at its base and a smaller diameter surface 44. Within the tool there is possibly a tapered guide slot 45 with, at its top, a guide slot for orientation pin 42 of the actuation point. The surfaces 43 and 44 are within the tool and have internal diameters such that they fit closely over surfaces 37 and 38 of the actuation point. Other features of the tool are lifting handle 25 and a flexible side handle 46 and frame 24 having gauges 35 (in the case of a hydraulic connector). Electric power and/or hydraulic fluid is supplied to the tool by multi-bore line 47, there being as many lines within the outer sheath of line 47 as required. Bend reducer 164 prevents kinking where line 47 enters the tool. Pipe 48 takes the lines to the centre of the tool and to the internals of the tool.

In this embodiment there is no rotating function and hence no hydraulic motor. Instead, the internals, in the case of a hydraulic connector, include sleeves which are hydraulically moved when the tool is mated with the actuation point to uncover ports and provide a pathway for fluid through the tool to the actuation point and into the module. A suitable arrangement of sleeves may be adapted from the fluid coupling described and claimed in published UK Patent Application No. 2195412.

In the case of an electrical connection, there may be movable sleeves with electrical contacts which mate to provide an electrical path. A suitable arrangement of sleeves is described and claimed in published UK Patent Application No. 2180107, particularly the arrangement shown in FIGS. 3 to 6. In the case of an electric connector there may be dielectric fluid surrounding the contacts and a passage for such fluid and hence the tool and actuation point of FIG. 2 may have dielectric fluid lines as well as electrical power lines.

The operation is similar to that described in FIG. 1, a workclass ROV tool with a manipulator arm bringing the tool over the actuation point and coarsely aligning larger diameter surface 43 of the tool with smaller diameter surface 38 of the actuation point. In this case the tool and point need not necessarily be vertical and since there is a hydraulically operated sleeve within it positive pressure is required to move the tool down over the point. However, the surfaces 37, 38 of the actuation point and the surfaces 43, 44 of the tool provide the same coarse and fine alignment to guide the tool and eventually hold it firmly on the point. There may be a hydraulic locking mechanism of a generally known type to lock the tool to the point if required.

FIG. 3 shows an actuation point for a fluid valve of a subsea module and a tool which can both isolate the valve and inject fluid. There are close similarities with the point and tool of FIG. 2 and similar features have been given the same reference numerals and will not be described again.

The actuation point of FIG. 3 combines a connection function similar to that of FIG. 2 with a rotation function similar to that of FIG. 1, so the actuation point has a drive nut 49 which engages with a drive dog of the tool. The tool has a hydraulic motor 27 and indicator pins 104 with guide marks 105 for the rotation function.

The internals of the actuation point are shown in FIG. 4 and those of the tool in FIG. 5 showing how the injection and isolation aspects are achieved and combined.

In FIG. 4 a valve body 50 has an inlet 51 and outlet 52. The valve within body 50 may be of any convenient type e.g. a needle valve, ball valve or gate valve. A valve stem 53 connected to the valve passes up through the valve body through suitable seals (not shown).

Fixed to valve body 50 by plate 54 and bolts 55 is main body 56 of the actuation point. This main body 56 is fixed into a structural plate 9 of a piece of subsea equipment by lock nut 57. Anti-rotation pins 58 prevent body 56 from rotating within the structural plate 9.

Main body 56 has a latch profile 59 and its top is frustoconical. It is hollow and open at the top. An internally screw-threaded support sleeve 60 passes up inside the main body 56 being screwed into the base of the body. Between support sleeve 60 and the outside of main body 56 is a moveable isolation sleeve 61. The top of isolation sleeve 61 has the same conical slope as the top of main body 56. It is held in the position shown in FIG. 4 by spring 62 forcing it against shoulder 63 of support sleeve 60.

In the position shown isolation sleeve 61 covers an annular port 64 on the inside of main body 56. Sets of double seals 65 seal isolation sleeve against the main body 56. It will be seen that isolation sleeve 61 seals port 64 in the position shown but that the port could be exposed if sleeve 61 were to be pushed down against the force of spring 62.

A number of vertical passages 66 extend down within main body 56 and connect port 64 with an outlet 67 at the base of the main body. A loop of pipe 68 connects this outlet 67 with the inlet 51 of the valve. If desired and for purposes described hereafter pipe 68 may have a T-junction 69 (indicated by dotted lines) with a length of pipe from valve inlet 51.

The internal screw thread of support sleeve 60 has a multi start thread 70 which co-operates with a external thread of an drive shaft 71. The bottom end of shaft 71 is slotted at 72 and valve stem 53 extends up within this slot. There is a T-bar 73 near the top of valve stem 53 fitting within the slot so that rotation of drive shaft 71 also rotates valve stem 53.

The top of drive shaft 71 is not threaded but has parallel grooves 74 which are used as indicator grooves. The multi-start threads of the support sleeve 60 and drive shaft 71 give a relatively large vertical movement of the shaft for a relatively small amount of rotation and the number of indicator grooves which are visible (to a TV camera on an ROV) above the top of support sleeve 60 indicates the number of turns which have been given to the drive shaft and hence whether the valve in valve body 50 is shut, part open or fully open. The top of drive shaft 71 has a drive nut 49 fixed to it.

FIG. 5 is a section through a tool positioned over the top of the actuation point of the valve of FIG. 4. The right hand side of FIG. 5 shows the tool positioned over the valve but not locked to it and the left hand side shows the tool locked to the valve and ready for actuation. The actuation point is identical with that of FIG. 4.

Starting from the top of FIG. 5, a motor plate 75 has a positive displacement hydraulic motor 27 fixed to it. Pipe 76 has hydraulic lines supplying hydraulic fluid to and from the motor. Framework 24 encloses and protects the motor 27. The tool may be held by an ROV by handle 25 or by a horizontal handle 46.

A drive shaft 77 from the motor extends down to a drive dog 78 of a size and shape such that it will fit over drive nut 49 of the valve.

Surrounding shaft 77 are a series of sleeves capable of relative vertical movement. Immediately surrounding shaft 77 is piston sleeve 79 having a horizontal top portion 80. This sleeve is retained by a ring 81 which holds spring 82 around drive shaft 77. Spring 82 around drive shaft 77 has its bottom end on the drive dog 78 and tends to push ring 81 up relative to the drive shaft. A lock ring 83 above ring 81 transmits the spring force to piston sleeve 79 so that it is, in effect, locked to ring 81.

The bottom end of piston sleeve 79 is shaped and positioned so that it abuts against isolation sleeve 61 of the valve. Piston sleeve 79 is of a thickness such that it can have vertical bores within it. There are at least 3 such bores each having an inlet in the horizontal portion 80 of piston sleeve 79. One inlet 84 is shown on the right hand side of FIG. 5 leading to bore 85. At the bottom of bore 85 is a port 86. As described in more detail hereafter port 86 is designed to line up with port 64 in the valve main body 56. Inlet 84, bore 85 and port 86 are thus the pathway through which fluid can be injected by the tool into the valve.

The left hand side of FIG. 5 shows two inlets 87, 88. These lead to two bores one of which is shown at 89 and which leads to just below a projection 90 on the outside of piston sleeve 79. The other bore (not shown) leads to just above projection 90. For ease of assembly projection 90 is a ring held onto piston sleeve 79 by a circlip and with appropriate seals on either side.

At the outside of horizontal portion 80 of piston sleeve 79 is a downwardly projecting operating sleeve 91. Between the space formed by piston sleeve 79 and operating sleeve 91 is a further main sleeve 92. Outside main sleeve 92 is a locking sleeve formed of an upper part 93 and lower part 94. A locking collet 95 fits between main sleeve 92 and the lower part 94 of the locking sleeve. There are locking ring dog segments 96 fitting into a recess in the upper part 93 of the locking sleeve.

The top half of main sleeve 92 is cut away on its inside and its top has a ring 97. Lock ring 98 holds this ring 97 onto the main sleeve 92 and there is a further outside ring 99 and lock ring 100 which act as a stop for the locking sleeve.

Projection 90 of piston sleeve 79 projects into the cut away inside portion of main sleeve 92. It will be seen therefore that the space 101 between Piston sleeve 79 and main sleeve 92 is equivalent to a cylinder and projection 90 to a two sided piston. Hydraulic fluid injected through inlet 88 and bore 89 will force projection 90 and piston sleeve 79 upwards within cylinder 101 and hydraulic fluid injected through inlet 87 will go through its bore to the top of projection 90 and tend to force it downwards.

There are double seals 102 at all surfaces around cylinder 101 where there is sliding movement and the possibility of leakage of hydraulic fluid. There are also double seals 103 above and below port 86.

To complete the description of FIG. 5 before explaining its operation, FIG. 5 also shows pins 104 extending up from the horizontal portion 80 of piston sleeve 79. These pins pass through motor plate 75 and act as the motor reaction pins and also as indicator pins, having indicator grooves 105 at their tops.

Inlets 84,87 and 88 have pipes 180 extending up to the ROV. Depending on the operation required, inlet 84 may be connected up to an ROV accumulator of hydraulic fluid, dielectric fluid, grease or any other fluid. Inlets 87 and 88 are connected to separate hydraulic fluid supplies.

Finally there is a vent line 106 in piston sleeve 79 so that sea water is not trapped between the tool and actuation point forming a hydraulic lock.

To describe the operation, the right hand side of FIG. 5 shows the tool as it is initially landed by the ROV onto the valve.

In the embodiment of FIGS. 3, 4, and 5 surface 37 (FIG. 3) forms the larger diameter surface of the actuation point and surface 38 the smaller. In the tool, the bottom of locking sleeve 94 forms the larger diameter surface and the bottom of main sleeve 92 the smaller. The ROV with a manipulator arm brings the tool over the actuation point and lowers it onto the point, coarse alignment to effect this being provided by the larger diameter surface (locking sleeve 94) of the tool going over the smaller diameter surface 38 (FIG. 3) of the actuation point. At this point, the tool can be released from the manipulator arm or the grip of the arm can be loosened. Downward movement under gravity brings the locking sleeve 94 to surface 37 of the actuation point and the tip of main sleeve 92 to surface 38 as shown on the right hand side of FIG. 5. The tool has thus been accurately aligned with the actuation point but it has not been locked to it nor have the injection and isolation mechanisms been activated. FIG. 5 shows how this is done.

Further downward movement of main sleeve 92 is prevented because its bottom is abutting the main body 56 of the actuation point. At this point, piston sleeve 79 has not yet come into contact with isolation sleeve 61 of the valve, nor has drive dog 78 come into contact with drive nut 49 of the valve. Projection 90 is also at the top of cylinder 101. The end of locking collet 95 is on a level with latch profile 59 of the actuation point, but since locking collet 95 is spring loaded outwardly it does not enter the profile.

Hydraulic fluid pressure is now applied through inlet 87 and its corresponding bore to the top of projection 90. The space below projection 90 in cylinder 101 is vented through bore 89 and inlet 88. This hydraulic pressure will force projection 90 and piston sleeve 79 down. Since operating sleeve 91 is fixed to piston sleeve 79 this also moves down. The end of operating sleeve 91 bears against locking dog segments 96 so the upper and lower parts 93 and 94 of the locking sleeve are also moved down. This movement continues until locking dog segments 96 reach recess 107 in main sleeve 92. Segments 96 then move into this recess. At this point the lower part 94 of the locking sleeve has passed over the lower end of locking collet 95 and has forced it into latch profile 59 of the actuation point so that the tool is now firmly latched to and aligned with the valve.

Piston sleeve 79 carries the whole of the tool with it in its downward movement, the only non-moving part being main sleeve 92. Ring 81 transmits the movement of piston sleeve 79 to the drive shaft 77 and this in turn takes the motor 27, motor plate 75 and frame 24 with it. The sloping bottom of piston sleeve 79 eventually contacts the sloping top of isolation sleeve 61 of the valve. Continued downward movement thus forces isolation sleeve 61 down until port 86 of piston sleeve 79 lines up with port 64 of valve main body 56. This continued movement of piston sleeve 79 means of course that operating sleeve 91 continues to move down, but since locking dog segments 96 are in recess 107 this downward movement can continue without transmitting further downward movement to the locking sleeve and locking collet.

Drive dog 78 contacts drive nut 49 just before piston sleeve 79 has completed its full length of travel (i.e. the length of cylinder 101). As piston sleeve 79 continues to push down isolation sleeve 61, drive dog 78 is held against further downward movement. Consequently drive dog 78, drive shaft 77, motor 27 and motor plate 75 stay still while piston sleeve 79 move on down to space itself from the motor plate 75. This is the final relative movement, so that the final positions of all the tool parts are as shown on the left hand side of FIG. 5. This position can be verified by a TV camera on the ROV checking on the indicator grooves 105 of guide pins 104.

At this point, the passage through injection line 84, bore 85 and port 86 of the tool to port 64 and the passages in the valve can be pressure tested to ensure that the pathway for fluid into the valve is pressure tight. Then and then only, the motor 27 can be actuated to rotate valve stem 53 of the valve and hence alter the valve position. The operation may be either to open or shut the valve depending on the initial position of the valve before deployment of the tool. The required fluid can be injected through the pathway described above to valve inlet 51. If there is a T-junction 69 this can be used to inject fluid directly into a fluid system. The valve, which is shut for the operation, isolates the remainder of the hydraulic system. This operation could be required, for example, if line 52 was broken or leaking, or otherwise immobilised, and there was a need to use an external source of hydraulic fluid to pressure up and actuate a fluid system in the subsea equipment.

When the required operation of pressure testing or injection of fluid has been completed, the tool can be withdrawn by reversing the sequence of operations described above. The motor is used to return the valve to its required normal position. If the valve has been closed, pressure will be applied through inlet 84 to test the valve seats. Hydraulic pressure is now applied to below projection 90 in cylinder 101, the space above being vented. Piston sleeve 79 is thus moved upwards, the sequence of steps following in reverse order until the position shown at the right hand side of FIG. 5 is reached again. The ROV can then be used to lift the off actuation point.

There is an additional safety feature of the tool by which it can be released in the event of a hydraulic failure. If supply lines to inlets 87 and 88 were to be fractured then the springs of the valve and tool would return the tool to the free position, as shown on the right hand side of FIG. 5. This movement could be assisted by an upward force by the ROV. On release of the tool isolation sleeve 61 would shut off the fluid flow.

FIG. 6 shows how an actuation point can be converted into a coupling thereby allowing any two parts of a subsea production system to be connected hydraulically or electrically. FIG. 7 shows a tool for effecting this conversion.

FIGS. 6 and 7 utilise embodiments shown in previous FIGS. but combine them in different ways.

Thus FIG. 6 shows an actuation point at the base forming part of a subsea module, a pin fitting over the point with a locking collet to convert the point to a coupling and a spigot at the top of the pin which can be rotated to drive the pin sleeves into the actuation point.

FIG. 7 shows the tool used to attach the pin of FIG. 6 to the actuation point, to rotate the spigot and able to inject into it.

In FIG. 6, the right hand side shows the pin landed onto the actuation point but not locked to it and the left hand side shows it locked. The internals of the actuation point and pin are not shown but they can be of any convenient type having moveable sleeves which seal pathways in the point and pin when they are separate, but which open up pathways when the pin is brought to the point and pressure is exerted to move the sleeves. It could thus be an actuation point and pin for a hydraulic pathway as per published UK Patent Application No. 2195412 or for an electrical pathway as per FIGS. 3 to 6 of published UK Patent Application No. 2180107.

In FIG. 6 the fixed external part of an actuation point is shown at 110 fixed into a structural plate 9 of a subsea module. The moveable sleeve plug portion of the actuation point is shown at 111. It will be seen that the actuation point has a larger diameter surface 37 and smaller diameter surface 38 as for other actuation points. The point has a latch profile 59.

The pin is formed by a moveable cylinder 112 terminating in a collet sleeve 113. Collet sleeve 113 forms the larger diameter surface of the pin. Within cylinder 112 is a fixed cylinder 114 which is spring-loaded relative to moveable cylinder 112 by springs 115 fitting over guide dowels 116. There may be several such springs and dowels, e.g. 8 or 12. Between cylinder 113 and 114 is a collet 117 which is biased outwardly.

The bottom of inner cylinder 114 forms the smaller diameter surface of the pin. Line 150 which may be an electrical cable or cables or a fluid line or lines brings power or fluid into the pin and down through its internals to where the pin contacts the plug.

At the top of the pin is a spigot which is essentially the same as the spigot of FIG. 1. Thus it has a non-rotatable body 8 with external reaction splines 13 and an inner rotatable mandrel 15 with driving splines 18. Body 8 has a latch profile 118 for a collet of the tool of FIG. 7. It is held within cylinder 112 but there can be relative axial movement between it and cylinder 112. To this end there is a stop ring 119 and retainer ring 120 to limit upward movement of cylinder 112. As described hereafter, downward movement of cylinder 112 relative to body 8 can be effected by a downward force exerted by the tool of FIG. 7. Stop pins 121 fixed to centre portion 181 of the pin act as stroke stop pins and anti-rotation pins preventing relative rotation between body 8 and centre portion 181. Cylinder 112 has a window 122 for installing pin 121 on centre portion 181.

The bottom part of rotatable mandrel 15 is externally screw threaded into an internally screw threaded sleeve 123 within pin centre portion 181 and forming the toP of the pin internals. Rotation of mandrel 15 thus moves sleeve 123 and pin centre portion 181 downwards depressing plug 111 of the actuation point as will be seen by comparing the right and left hand sides of FIG. 6.

There is a lock ring 124 and energising screws 125 between body 8 and rotatable mandrel 15 to ensure that mandrel 15 only rotates, so when it is rotated it exerts downward pressure on sleeve 123 and pin centre portion 181.

Inside rotatable mandrel 15 is a retainer rod 126 with a spring 127 around it. This is part of a pressure balanced valve so that when fluid pressure is applied through the tool into the pin (as described hereafter, the tool (which is unlocked from the pin at this stage) is not lifted off by back pressure. Retainer rod 126 prevents valve plug 131 from coming out under the closing force of spring 127.

In the spigot, there is provision for supplying fluid (e.g. flushing dielectric fluid) through port 128 and a groove 129 in sleeve 123 to the centre portion 181 of the pin. The previously mentioned pressure balanced inlet valve is in the bore 130 at the top of mandrel 15. It is formed by plug 131 with seals, closing spring 127 and plug retainer rod 126. A vent line 132 is provided from the area surrounding rod 126 to prevent fluid being trapped (hydraulic block) under plug 131 when it is depressed. All relatively moving surfaces of the spigot have suitable double seals as shown.

Finally, in FIG. 6 an orientation pin 161 may be fixed to the body 110 of the actuation point, which in cooperation with a slot 162 in outer cylinder 113 orientates the pin with the actuation point. Orientation may be required in certain types of coupling.

The tool of FIG. 7 is designed to fit over and releasably latch onto the spigot of the coupling of FIG. 6 so that they can be taken as a unit by a ROV to an actuation point. The coupling is attached to the actuation point and pathways opened up by the tool operating the spigot, after which the tool can be lifted from the coupling and recovered. Release of the tool allows the pin to lock onto the actuation point as shown on the left hand side of FIG. 6.

FIG. 7 shows at the top of the tool an arrangement similar to the tool of FIG. 5. There is a framework 24, lifting handle 25, hydraulic motor 27 with flexible hydraulic lines 76, gauges 35 and an umbilical 47. Motor 27 drives, through a reduction gearbox 30, a hollow cog 133 which in turn drives a rotation mandrel 134 having driving splines 135 at its bottom designed to mesh with driving splines 18 of the spigot. As in FIG. 1, there is a degree of play between cog 133 and mandrel 134 equivalent to half the width of the spline to facilitate meshing.

The bottom of the tool is formed of an outer collet cylinder 136, and an inner cylinder 137 between which is an outwardly biased collet 138. Inner cylinder 137 is immoveable being fixed by screws 139 to the motor assembly. Its base has reaction splines 140 designed to mesh with the reaction splines 13 of the spigot.

Outer cylinder 136 is, however, moveable axially. It has a projection 141 within an enclosed space 142 between cylinders 136 and 137, this space acting as a hydraulic cylinder and projection 141 as a two sided piston.

Hydraulic operating lines 143 and 144 lead through ports 145 and 146 of cylinder 136 to above and below projection 141 so that it can be moved up and down in the cylinder.

Cylinder area 142 is closed at the top by a cap ring 147 between cylinders 136 and 137 having appropriate seals. Circlip 148 holds cap ring 147 onto inner cylinder 137. At the top of outer cylinder 136 is a spacer ring 149 acting as a guide for the movement of outer cylinder 136 relative to inner cylinder 137.

Describing now rotatable mandrel 134 in more detail, there is a retainer ring 151 and lock ring 152 to hold it relative to inner cylinder 137. It has an isolation sleeve 153 which is spring loaded by spring 154 to hold it firmly against the top of the rotatable mandrel 15 of the pin.

At the top of inner cylinder 137 is a fluid line 155 (for e.g. dielectric fluid) and a port 156 which matches up with port 157 in rotatable mandrel 134. There are seals 158 either side of the ports. A passage 159 runs down inside mandrel 134 to another port 160 at the bottom of the mandrel 134.

In FIG. 7 the spigot of the pin is shown only in outline for the most part. However, the top of rotatable mandrel 15 of the spigot is shown in section to illustrate how the end of rotatable mandrel 134 fits inside the end of rotatable mandrel 15 of the spigot so that port 160 of the tool lines up with port 128 of the spigot. There is thus a pressure balanced fluid flow path through the tool and spigot to the centre portion 181 of the pin and the actuation point.

Finally, although, as previously stated, details of the spigot are not generally shown in FIG. 7, FIG. 7 does show the top of outer cylinder 112 of the pin and the stop ring 119 and retainer ring 120 of body 8.

The right hand side of FIG. 7 shows the tool locked to the spigot and the left hand side shows it unlocked.

If it is desired to run and attach a pin of FIG. 6 to an actuation point of a subsea module to form a coupling, the pin and tool are deployed locked together, with the tool being held by handle 25 by a manipulator arm of a ROV. To engage the tool over a pin from a sub-sea actuation point will need alignment and guidance.

The pin, therefore, has the reaction splines 13 as a larger diameter surface and the driving splines 18 as the smaller diameter surface, while the tool has the end of inner cylinder 137 as its larger diameter surface, and the end of rotatable mandrel 134 as its smaller diameter surface. Remote alignment and guidance can thus be effected in the same way as the embodiment of FIG. 1.

To lock the tool to the pin, hydraulic fluid is admitted via line 144 and port 146 to the top of cylinder area 142 with port 145 and line 143 being opened to vent. Projection 141 and outer cylinder 136 are moved down thereby forcing collet 138 into groove 118 of the spigot as shown at the right hand side of FIG. 7. When collet 138 is locked into groove 118, collet sleeve 136 continues to move downward until it engages the top of cylinder 112 of the pin. Cylinder 112 is thus forced down compressing spring 115 and unlocking collet 117 leaving it in the open position (see the right hand side of FIG. 6).

The tool and pin thus locked together can, for the purposes of the invention be considered as a unit to be taken or transferred by a ROV to a subsea actuation point. Again guidance and alignment are provided by larger diameter surface 37 and smaller diameter surface 38 of the actuation point and in the pin (which can be considered as part of the tool) there is the end of outer cylinder 112 as the larger diameter surface and the end of inner cylinder 114 as the smaller diameter surface. The tool and pin can thus be coarsely aligned and then accurately aligned in the same way as for previous Figures.

Once the pin has been accurately aligned with the actuation point then the grip of the manipulator arm of the ROV on the tool can be relaxed and the tool can be released from the pin. Hydraulic fluid pressure is applied through line 143 and port 145 to the cylinder area 142 below projection 141 while venting port 146 and line 144 above projection 141. Outer cylinder 136 is forced up. This releases it from engagement with the top of cylinder 112 of the pin. Springs 115 can, therefore, move cylinder 112, locking collet 117 into groove 59 of the actuation point and hence locking the pin to the actuation point (see left hand side of FIG. 6). The upward movement of cylinder 112 is limited by stop ring 119 on spigot body 8. Further upward movement of outer cylinder 136 releases collet 138 of the tool from engagement with groove 118 of the pin thereby freeing the tool from the pin (see left hand side of FIG. 7).

Although the tool is now unlocked from the pin, it is still firmly held and aligned with the pin by the larger and smaller diameter surfaces and tool mandrel 134 is meshed with pin mandrel 15.

Motor 27 of the tool can thus be operated to rotate mandrel 15 of the spigot. Sleeve 123 and centre portion 181 of the pin are moved down. This, in turn, pushes plug 111 of the actuation point down opening up whatever pathways are built in to the pin and plug. A fluid pathway can be pressure tested at this point. An electrical pathway can be flushed with dielectric fluid using the ports and passages in the rotatable mandrel 134 of the tool and the rotatable mandrel 15 of the spigot. The pressure balanced inlet valve for the dielectric fluid prevents any back pressure lifting the tool off the pin.

Finally the tool can be removed from the pin by the ROV, the manipulator arm gripping handle 25 again. The tool can now be withdrawn by the ROV and recovered leaving the locked pin in place to form a coupling.

To recover a coupling the sequence can be reversed. First the tool is run and landed and aligned with the pin. Then the hydraulic motor of the tool is used to rotate the mandrels and close the pathways in the actuation point and pin. Then the tool is locked to the pin by pushing down piston 141 of collet sleeve 136, this action automatically releasing the pin from the actuation point and allowing the tool and pin to be recovered as a unit.

A coupling as illustrated by FIG. 6 can have a very wide variety of uses in a subsea production system. It can bring in hydraulic fluid or electric power via an umbilical from a remote source or it can link with another coupling or another subsea module or port to provide a pathway for fluid (either hydraulic or any other fluid) or electrical power or electrical signals between modules. It could also be used for pressure testing a hydraulic system.

The tool of FIG. 7 has a number of functions enabling it to be used as a universal tool for a variety of purposes. Thus it has a latch function enabling it to be releasably locked to an actuation point or to a coupling such as that shown in FIG. 6. It has a torque function enabling it to rotate part of the actuation point or coupling, and it has an injection function enabling fluids to be injected through it into the point on coupling.

FIG. 8 shows an actuation point which is a grease or small hydraulic volume injection nipple. The universal tool of FIG. 7 can be placed over it in exactly the same way as it is placed over the coupler of FIG. 7 and latched to it in the same way. Then torque can be applied to open the injection nipple itself and finally grease can be injected.

FIG. 8 is a two-part drawing, the left hand side of the centre-line of the drawing showing the valve of the nipple closed and the right hand side showing the valve open.

This nipple forms part of a sub-sea module. It has a spigot 8 and it is held in structural plate 9 of a sub-sea module by nut 12. The portion below plate 9 is externally screw threaded and houses the valve itself. Thus valve seat body 167 fits inside the central bore of spigot 8 and is held by cap 168. There is a metal to metal seal at 169, normal seals at 170, and an anti-rotation key at 171. The top of valve seat body 167 is internally chamfered to form the valve seat 172. From body 167 a stainless steel line 173 can transmit the grease or fluid injected to whatever part of the sub-sea module requires it.

The upper part of spigot 8 above structural plate 9 is designed to receive the tool of FIG. 7 and is thus externally indentical to the top of the coupler of FIG. 6. The same reference numerals are used as for FIG. 6, to which reference may be made for the function of the various parts.

The internals of the upper part of the spigot are also similar to the coupler of FIG. 6 except that the bottom part of rotatable mandrel 15 forms the valve for seating on valve seat 172. The bore of spigot 8 is hexagonal as is valve stem 174. Stem 174 terminates in cone 175 which mates with valve seat 172. Valve stem 174 is internally screw threaded onto external screw threads of mandrel 15, and has flow grooves 176. Inset drawing FIG. 8B is a plan view of stem 174 and its grooves 176. Stem 174 also has a vent hole 203 to prevent an airlock between it and mandrel 15.

In operation the tool of FIG. 7 can be lowered by the manipulator arm of an ROV onto the grease nipple of FIG. 8 using the same coarse and fine alignment surfaces as described with reference to previous figures. It is then latched to the nipple, again as for FIG. 7, with latches 138 being locked into groove 118. Torque can then be applied by the tool to mandrel 15, lifting valve stem 175 from valve seat 172. Grease or fluid can then be injected through passage 159 of the tool to the top of the nipple, flowing down through port 128 and grooves 176 to and through the open valve seat 172 and hence through line 173 to the required component of the module. Upon completion of the injection the valve can be closed by applying opposite torque to mandrel 15 via the tool, the tool can then be unlatched and lifted off.

FIGS. 9 and 10 show a lifting coupling and how it can be used in combination with the universal tool of FIG. 7. Essentially the lifting coupling shown in FIG. 9 can be lowered onto an actuation point of a sub sea module using the tool of FIG. 7 and locked to the point. The tool can then be released from the coupler and the coupler used to lift a part or all of the sub sea module of which the actuation point forms part. The lifting coupling of FIG. 9 is, it will be seen, similar in its externals to the coupler of FIG. 6. Thus at its bottom end it has the s@me arrangement of latches 117 for locking the coupler to an actuation point and the same sleeve 113 loaded by springs 115 for effecting the latching. At its top end it has the same external arrangement of rotatable components as for the coupler of FIG. 6 thereby allowing it to be locked with the tool of FIG. 7 in the same way as described with reference to FIGS. 6 and 7. The application of torque through the tool also allows rotation of mandrel 15 through splines 18.

The coupling of FIG. 9 is shown in place over an actuation point similar to that of FIG. 7, i.e. an actuation point with reaction splines and moveable splines that can be used to apply torque to the actuation point. The internals of the coupler and the bottom end of rotatable mandrel 15 are designed to cooperate with this type of actuation point. Thus at the bottom of mandrel 15 is socket 32 (of FIG. 1) which is internally splined to mesh with the driving splines of the actuation point mandrel. Socket 32 is held to mandrel 15 by lock nut 177 and washer 178. The actual location of ring 32 on mandrel 15 is via splines 179 giving, as previously explained, a certain amount of play to facilitate the meshing of ring 32 with the actuation point.

For the lifting function the coupling has a lifting bridle 180 firmly attached to the body of the coupler by bolts 182. The bridle 180 passes through the eye of a lifting strap 183.

In FIG. 9 the left hand side of the centre-line shows the coupler positioned over the actuation point and locked to it: the right hand side shows it unlocked. The locking and unlocking sequence will be identical with that described with reference to FIGS. 6 and 7.

FIG. 10 shows how the lifting coupling of FIG. 9 may be deployed. The figure shows an ROV 184 with umbilical 185, a grabber arm 186 and a manipulator arm 187. Arm 187 holds a universal tool of FIG. 7 (indicated as 188) and the lifting coupling of FIG. 9 indicated as 189. The tool and coupling are deployed locked together in the same way as the tool and coupling of FIGS. 6 and 7. Lifting bridle 180 and strop 183 connect the coupling to a central lifting point 190 beneath the ROV. This can be in the form of a quick release coupling with an overload shear pin 191.

The ROV is shown in position just above a sub-sea component 192, which may be located within guidance framework 193. The module 192 is shown locked into a subsea module 194 by lock dogs 195. At the top of the component is the lifting spigot 196. It will be appreciated that this depiction of a sub-sea module is purely schematic and not necessarily in proportion.

From the position shown in FIG. 10 the ROV and manipulation arm are maneuvered to place the tool 188 and coupling 189 onto the spigot 196. The coupling is then locked to the spigot.

It will be appreciated that the amount of lift that can be applied directly via the manipulator arm, tool and coupling will be very limited, amounting to some kilograms only. However, unlocking the tool 188 from the coupling 189 and lifting the tool away, allows the load to be transferred through the lifting bridle and strop to the lifting point 190 beneath the ROV. A much greater lifting force can now be applied amounting to a few hundred kilograms. If this greater lifting force is still inadequate the lifting strop can be attached to some other lifting device than the ROV, i.e. it could be attached to a lifting cable leading up to the sea surface and a surface vessel, the lifting power then being only limited by the strength of the cable and the capacity of the crane on the surface vessel.

The component must of course, be freed from the module to allow the lift. Some existing modules have locks which can be released remotely and it is also possible to envisage that the lifting spigot 196 could be an existing actuation point for a sub-sea valve or other component. However, lifting of a component may well need to be an emergency operation following failure of the normal release mechanisms and existing actuation points may not be designed with sufficient strength to act as the lifting point for the whole module. Desirably, therefore, the component is designed to allow it to be lifted in the way shown in FIGS. 9 and 10. To this end the lifting spigot 196 may be a purpose designed spigot solely dedicated to a lifting function, i.e. with the strength to bear the weight of the component and with a mechanism such that rotation of the spigot by the universal tool releases the lock ring 195 and frees the component from its template.

FIG. 11 shows a torque control tool which can be deployed using the universal tool of FIG. 7 and left in place over an actuation point. The tool of FIG. 11 can thus be considered in some ways as equivalent to a coupling and in some ways as an alternative to deployment of a tool similar to that of FIG. 1. FIG. 1 shows a torque-actuated point which has a mandrel which can be rotated to adjust a sub-sea component, e.g a valve or insert-choke. As shown in FIG. 1 a simple tool according to the present invention can be deployed by bringing it to the actuation point, placing it over it, adjusting the valve or choke by rotating the mandrel, and then removing and recovering the tool. Such an arrangement may be suitable in situations when only occasional adjustments to the value or choke are necessary.

There may, however, be situations when fairly frequent adjustment may be required. Rather than bringing a tool to the actuation point each time an adjustment is required, the tool shown in FIG. 11 is designed to be brought to the actuation point by the universal tool of FIG. 7 and, if desired, left in place. To that end it consists of selected components of tools shown in previous figures.

Thus it will be seen in FIG. 11 that the actuation point is shown as similar to that of FIG. 1 and that the tool has the basic internals of the tool of FIG. 1, i.e, it is designed to mesh with the splines of the actuation point and has a motor 27 designed to drive socket 32 and hence rotatable mandrel 15 of the actuation point.

Since the tool may have to remain in place it has the latches 117 to lock it to the actuation point and a locking mechanism for the latches equivalent to that of the coupling of FIG. 6. And since it is deployed using the universal tool of FIG. 7 it has similar top external profile to the coupling of FIG. 6, including groove 118 to receive the latches of the tool (138 of FIG. 7). As will be recalled with reference to FIGS. 6 and 7 the latches to lock and unlock the tool to and from the coupling and the latches to lock and unlock the coupling to and from the actuation point are operated hydraulically so the top profile of the tool of FIG. 11 has its internal hydraulic receptacle and pressure balanced valve (126, 130 & 131) to receive the stab 13A of the tool. There is, however no need for a torque function, so as shown in FIG. 11, there is no rotatable mandrel in this upper part of the tool and there need be no splines to effect the rotation.

In operation, the tool of FIG. 11 is deployed latched to the universal tool of FIG. 7, and placed over the actuation point. The universal tool is unlatched and the tool of FIG. 11 latched to the actuation point. The universal tool is then removed and recovered leaving the tool of FIG. 11 in place and capable of rotating the mandrel of the actuation point whenever required through its motor 27.

As shown the tool has a hydraulic motor supplied with fluid though umbilical 165, but it could equally be an electric cable. The tool of FIG. 11 is also shown as fitting over and operating a torque-actuated point, but it could equally be of a type to operate a stab-actuated point (e.g, a semi-permanent tool equivalent to the removable tool of FIG. 2) or a torque-and stab-actuated point (e.g, a semi-permanent tool equivalent to the removable tool of FIGS. 3 and 5).

FIG. 12 illustrates another variant of the use of the semi-permanent tool of FIG. 11 and how it could be deployed on a sub-sea module. Thus FIG. 12 shows diagramatically a sub-sea module 192, having above it a control pod or module 197 with hydraulic or electrical connectors 198 between the modules. Control module 197 is also shown as having a lifting mandrel 196. Beside control module 197 is a dummy mandrel 199. This dummy mandrel is designed to locate a semi-permanent control tool 200 of the type shown in FIG. 11 as a parking location for the tool 200 when the control module is run or pulled. Control tool 200 is linked to control module 197 by an umbilical 165.

FIG. 12 also shows, separate from module 192, an actuation point 201, which could be for any adjustable component 202, e.g, a choke or valve, positioned at any point on the sub-sea installation. Finally it shows an ROV 184, with manipulator arm 187 holding a universal tool 188 of the type shown in FIG. 7.

Control tool 200 may be normally positioned on the dummy mandrel 199. It could be, but need not be, locked to it. As the tool is spring loaded it will lock unless universal tool 188 is on it. If circumstances arise requiring adjustment of component 202, ROV 184 with its manipulator arm 187 holding universal tool 188 may be deployed to lift control tool 200 off dummy mandrel 199 and transfer it onto actuation point 201. The ROV will depart and the control module using a travel sensor in tool 200 may intelligently sense and control component 202 as the production system requires.

It will be appreciated that a sub-sea installation may have a number of components like 202 with actuation points 201 requiring adjustment from time to time. FIGS. 12 shows an arrangement whereby a single control tool located on a dummy mandrel could be deployed to adjust any number of actuation points, the only limitation being that the length of umbilical 165 has to be such that the control tool is within reach of all the actuation points.

Since the present invention has a large number of embodiments and variations within its compass, FIG. 13 represents schematically the inter-relationship between the various embodiments as illustrated by the previous FIGS. 1 to 12.

From left to right of the drawing, the first embodiment is a torque tool and torque spigot, as illustrated in FIG. 1, the spigot actuating e.g. a valve or choke. The second embodiment is a stab tool and stab receptacle, as illustrated in FIG. 2, the receptacle actuating, e.g. hydraulic and/or electrical connections. In the third embodiment, the tool has both torque and stab functions and cooperates with a receptacle with both these actuators e.g. a receptacle for valve isolation and fluid injection as in FIGS. 3 to 5. Since this embodiment is for fluid injection the tool and receptacle have ports opened by the torque or stab functions to receptacle have flow passages to allow injection.

The second and third embodiments may have a latch to lock the tool to the receptacle. Such a latch could also be used in the first embodiment, if desired, but it is not so necessary.

The fourth embodiment is the universal tool of FIG. 7, having torque and/or stab functions, ports for fluid injection and a locking latch. This tool may be used for direct attachment to a spigot e.g. the grease or fluid injection nipple of FIG. 8, but it may also be combined with various couplings to form two-part tools. FIGS. 6, 7 and 9–12 illustrate various two-part tools. In these embodiments the universal tool acts primarily to place the couplings on an appropriate spigot or receptacle, and if required, to leave it there. As shown by FIG. 13 the couplings all have locking latches and may have either a torque function, a stab function, or a torque function combined with lifting means. The torque and stab couplings may, as indicated by the arrows be deployed onto the actuation points of the first and second embodiments. The lifting coupling may be deployed with the spigot of the fourth embodiment, which may be especially designed and strengthened to take the lifting load. Alternatively for heavy lifts, the lifting coupling could be deployed with the spigot of the first embodiment.

Finally, FIG. 13 illustrates that the first three embodiments using single part tools and the universal tool of embodiment four on its own, besides functioning to actuate valves, chokes, connections etc. could also be used for light lifting operations.

I claim:

1. An actuation point and ROV-operable tool for actuating equipment of a sub-sea module, comprising:

(a) an actuation point which is a projection from a surface of the sub-sea module, said projection having two tool guidance surfaces of different external diameters, the larger diameter surface being nearer to the module than the smaller diameter surface, (b) a ROV-operable tool having a hollow interior adapted to fit over said projection and having two surfaces of different internal diameters, the larger diameter surface being at the end of the tool adjacent the module and adapted to fit closely over the larger diameter surface of the projection, and the smaller diameter surface being adapted to fit closely over the smaller diameter surface of the projection and, (c) means for actuating the equipment by action of the tool on the projection in which the larger diameter surfaces of the tool and projection do not move and provide the means for holding the tool on the projection against the forces applied by the tool to the projection, and the smaller diameter surfaces provide the means for actuating the equipment, said means being selected from a torque function, said smaller diameter surface of the projection being a rotatable spigot rotatable by rotation of the smaller diameter surface of the tool, a stab function, said smaller diameter surface enclosing a sleeve which is movable axially by axial movement of the smaller diameter surface of the tool, or both torque and stab functions, said smaller diameter surface of the tool having both a rotatable portion and an axially moveable sleeve, the smaller diameter surface of the tool being both rotatable and axially movable.

2. An actuation point and ROV-operable tool as claimed in claim 1 wherein the tool has a releasable latch cooperating with a groove of the projection for releasably locking the tool to the point.

3. An actuation point and ROV-operable tool as claimed in claim 1 wherein the tool and projection have ports uncovered by operating the torque or stab functions to allow fluid injection from the tool into the projection.

4. An actuation point and tool as claimed in claim 1 wherein the actuation point operates a valve or variable choke.

5. An actuation point and tool as claimed in claim 1 for electric or hydraulic connection.

6. An actuation point and tool as claimed in claim 1 for both isolation of a valve and fluid injection into a subsea module.

7. An actuation point and tool as claimed in claim 1 wherein the tool is formed of an upper part and a lower part the upper part having a releasable lock for locking it to the lower part.

8. An actuation point and tool as claimed in claim 7, wherein the upper part has a torque function, a releasable latch acting as the lock for the lower part, and ports for fluid injection.

9. An actuation point and tool as claimed in claim 7 wherein the lower part has a function selected from a torque function, a stab function or both torque and stab functions, and a releasable latch for locking the lower part to an actuation point.

10. An actuation point and tool as claimed in claim 7 wherein the lower part has lifting capability.

* * * * *